US006997444B2

(12) United States Patent
Weetman et al.

(10) Patent No.: US 6,997,444 B2
(45) Date of Patent: Feb. 14, 2006

(54) RADIAL DISC IMPELLER APPARATUS AND METHOD

(75) Inventors: Ronald J. Weetman, Rochester, NY (US); Gary Hodenius, Brockport, NY (US); Richard Howk, Pittsford, NY (US)

(73) Assignee: SPX Corporation, Charlotte, NC (US)

( * ) Notice: Subject to any disclaimer, the term of this patent is extended or adjusted under 35 U.S.C. 154(b) by 12 days.

(21) Appl. No.: 10/424,940

(22) Filed: Apr. 29, 2003

(65) Prior Publication Data

US 2004/0217492 A1 Nov. 4, 2004

(51) Int. Cl.
*B01F 3/04* (2006.01)

(52) U.S. Cl. ..... 261/91; 210/219; 366/317

(58) Field of Classification Search ..... 261/91, 261/87, 93; 366/317; 210/219
See application file for complete search history.

(56) References Cited

U.S. PATENT DOCUMENTS 3,204,768 A * 9/1965 Daniel ..... 210/197
3,323,782 A * 6/1967 Clough ..... 366/282
3,329,407 A * 7/1967 Clough et al. ..... 366/194
3,479,017 A * 11/1969 Thikotter ..... 261/91
3,560,379 A * 2/1971 Muskat ..... 210/738
4,066,382 A * 1/1978 Lakin et al. ..... 416/186 A
4,151,231 A * 4/1979 Austin et al. ..... 261/91
4,249,863 A * 2/1981 Connolly et al. ..... 416/185
4,979,986 A * 12/1990 Hill et al. ..... 75/711
5,198,156 A * 3/1993 Middleton et al. ..... 261/87
5,785,899 A * 7/1998 Young ..... 261/91
5,988,604 A 11/1999 McWhirter
6,715,912 B2 * 4/2004 McWhirter et al. ..... 366/265

* cited by examiner

*Primary Examiner*—Richard L. Chiesa
(74) *Attorney, Agent, or Firm*—Baker & Hostetler LLP

(57) ABSTRACT

A radial disc impeller for use with a liquid or liquid suspension mixing assembly, having an axis of rotation. The radial disc has a hub and at least one disc extending radially away from the axis of rotation. The disc is connected to the hub at first axial location. The disc impeller includes a first blade connected to the disc. The first blade has an extension that extends radially away from the axis of rotation. The disc impeller also includes a second blade connected to the disc. The second blade has an extension that extends radially away from the axis of rotation.

12 Claims, 5 Drawing Sheets

RADIAL DISC IMPELLER APPARATUS AND METHOD

FIELD OF THE INVENTION

The present invention relates to an improved aeration apparatus and method. More particularly, the present invention relates to an apparatus and method that relates to aerating disc aerators. The invention is useful, for example, for use in wastewater treatment plants for introducing oxygen into wastewater where the oxygen is used by biological elements that digest the waste. The invention is also useful in various other processes where the dispersion of gas and/or oxygen into a liquid or liquid suspension is required.

BACKGROUND OF THE INVENTION

In mass transfer processes such as waste treatment and bio-reactions, it is common to carry out these processes in an aeration vessel in which gas, such as oxygen and/or air, is introduced into a biodegradable liquid for treatment. These aforementioned processes are oftentimes utilized by municipalities and industry to treat waste water wherein the object of the process is to introduce air to the liquid and then micro-organisms in the liquid proceed to use this oxygen to digest the waste. The gas and/or air is commonly introduced by way of impellers, wherein the impellers aerate the liquid.

In aeration processes such as waste water treatment, it is common to employ impellers which are especially adapted for use on the surface of liquids in an open tank called surface aerators. Typical surface aerators commonly used in the art are generally either radial flow impellers or pitched blade turbines and/or disc impellers. The blades are usually flat, rectangular plates, which are pitched usually at an angle of 45° to the axis of rotation of the impeller. The aforementioned impellers are commonly located close to the static level liquid surface and a small portion of the width of the blade may project up through the surface. Typically, when the impeller is pitched forwardly, the upper edge of the blade is the leading edge while lower edge is the trailing edge. Alternatively, when the impeller is pitched backwardly, the upper edge is the trailing edge while the lower edge is the leading edge. The liquid is usually either pushed out in front of the angled blade and/or scooped by the blade and discharged radially across the surface of the tank with some of the liquid being sprayed into the atmospheric air from the outer upper surfaces of the blade. As a result of the spraying of the liquid into the atmospheric air, the liquid becomes aerated.

One disadvantage of the above described processes and impellers is that they can be very inefficient. The length of time required to effect the oxidation treatment can be as long as 24 hours. This time period combined with the fact that these waste treatment processes are oftentimes carried out continuously year round, provide a process that is very inefficient in terms of both time consumption and energy consumption.

Accordingly, it is desirable to provide an aeration apparatus and method for effectuating the more efficient dispersement or transfer of air and/or other gases into a liquid.

SUMMARY OF THE INVENTION

The foregoing needs are met, to a great extent, by the present invention, wherein in one aspect an apparatus and method are provided for effectuating the more efficient dispersement or transfer of air and/or other gases into a liquid.

In accordance with one embodiment of the present invention, a radial disc impeller for use with a liquid or liquid suspension mixing assembly having an axis of rotation is provided. The disc impeller includes a hub and a first disc having a radius that extends a first distance radially away from the axis of rotation. The disc is connected to the hub at a first axial location thereof. The radial disc impeller has a first blade connected to the disc, wherein the first blade has an extension. The extension extends a second distance radially away from the axis of rotation. The radial disc impeller also has a second blade connected to the disc, wherein the second blade has an extension. The second blade extension extends a third distance radially away from the axis of rotation.

In accordance with another embodiment of the present invention, a method for aerating a liquid in a mixing assembly having an axis of rotation, comprising: mixing a liquid; spraying a liquid in a radial direction in at least one spray pattern; and contacting the liquid with air, wherein said mixing step and said spraying step are carried out using a disc impeller comprising a hub; at least one disc extending a first distance radially away from the axis of rotation, the disc connected to the hub at a first axial location thereof; a first blade connected to the disc, the first blade having a first extension extending a second distance radially away from the axis of rotation; and a second blade connected to the disc, the second blade having a second extension extending a third distance radially away from the axis of rotation.

In accordance with yet still another embodiment of the present invention, an apparatus for aerating a liquid for use in a mixing assembly having an axis of rotation. The apparatus includes a means for contacting the liquid with air, wherein the means includes a hub and at least one disc extending a first distance radially away from the axis of rotation. The disc is connected to the hub at a first axial location thereof. The apparatus also includes a first blade connected to the disc, wherein the first blade has an extension that extends a second distance radially away from the axis of rotation. The apparatus also includes a second blade connected to the disc. The second blade has a second extension that extends a third distance radially away from the axis of rotation. The apparatus also includes a means for rotating the contacting means.

In accordance with another embodiment of the present invention, a radial disc impeller for use with a liquid mixing assembly having an axis of rotation and a radial axis extending through the axis of rotation is provided. The disc impeller has a hub and at least one disc connected to the hub at a first axial location thereof. The disc impeller also has a first blade connected to the disc. The first blade has a first portion oriented at a first angle to the radial axis. The first blade has second portion oriented at a second angle to the radial axis. The disc impeller additionally includes a second blade connected to the disc. The second blade has a first portion oriented at the first angle to the radial axis and a second portion oriented at the second angle to the radial axis.

In accordance with yet another embodiment of the present invention, a radial disc impeller for use with a liquid mixing assembly having an axis of rotation is provided. The disc impeller includes a hub and at least one disc connected to the hub. The disc impeller further includes a first blade connect the disc and a second blade connected to the disc. Both the first blade and second blade each have an upper edge. The upper edge has a first portion connected to the disc and a second portion not in contact with the disc.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
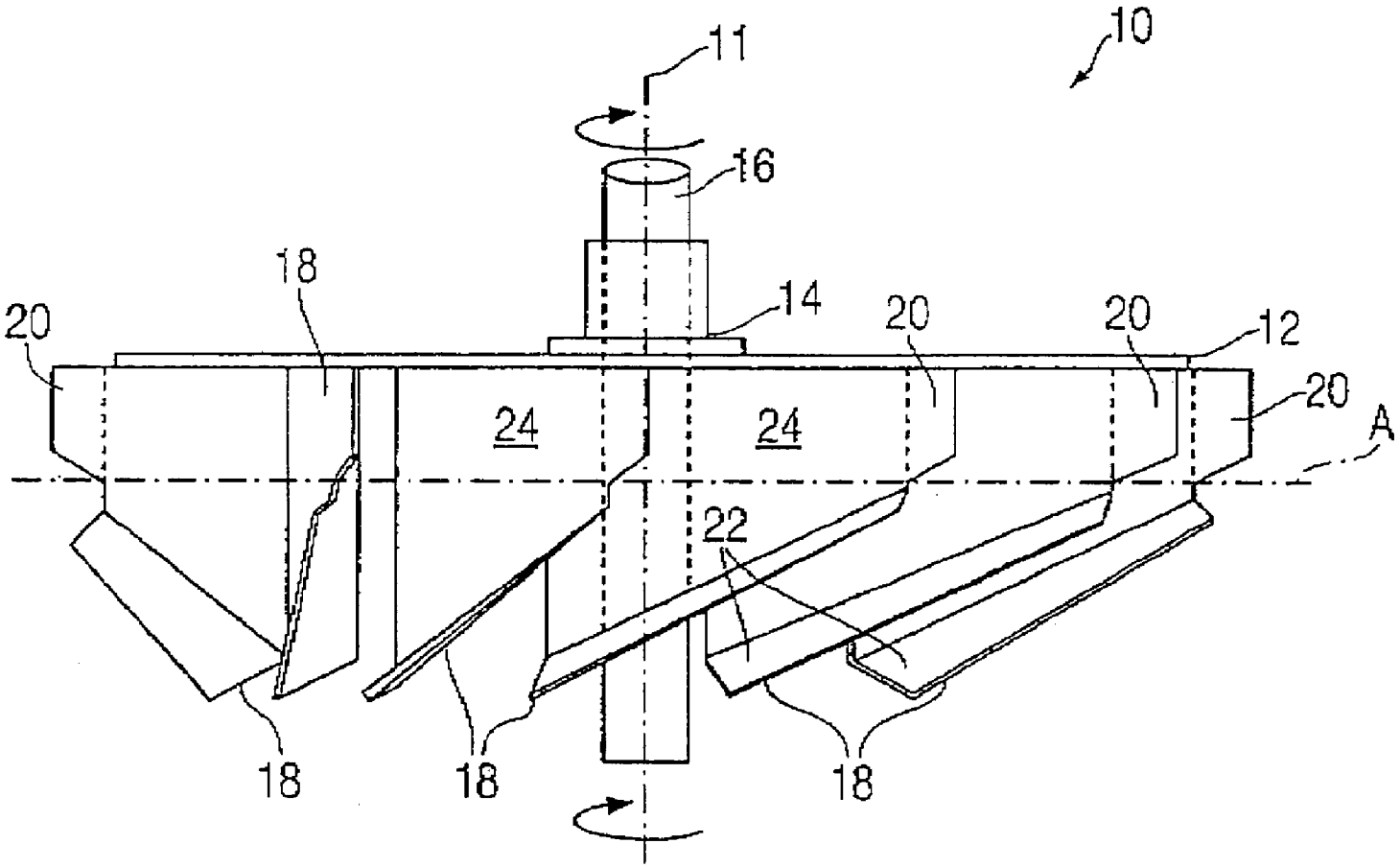
FIG. 1 is a partial perspective side view illustrating a radial disc impeller having extensions in accordance with an embodiment of the present invention.

The invention will now be described with reference to the drawing figures, in which like reference numerals refer to like parts throughout. An embodiment in accordance with the present invention provides an apparatus and method for mass transfer of gas and/or air into a liquid or liquid suspension. The present invention is preferably used in conjunction with waste treatment processes and/or fermentations processes that are commonly carried out in a mixing vessel. In such an arrangement, the mass transfer process is utilized to contact air to a liquid in a mixing vessel or aeration basin. It should be understood, however, that the present invention is not limited in its application to waste treatment, but, for example, can be used with other processes requiring liquid aeration.

Referring now to the figures, FIG. 1 illustrates a partial perspective view of a radial disc impeller, generally designated 10, in accordance with an embodiment of the present invention. The disc impeller 10 is preferably used in conjunction with a mixer assembly to transfer gas and/or air to a liquid or liquid suspension and has an axis of rotation 11. The disc impeller 10 includes a disc 12 connected to a hub 14. As illustrated in FIG. 1, the hub 14 is connected to a shaft 16 of the mixer assembly and rotates therewith. The disc impeller 10 also includes eight blades, generally designated 18, attached to the disc 12 such that they are generally positioned at a "back swept" position to the axis of rotation 11. In the embodiment depicted, each blade includes an extension 20 and an angled portion 22. The angled portions 22 are preferably positioned at an angle ranging from approximately 30° to approximately 60° relative to the axis of rotation.

The blades 18 are preferably attached to the disc 12 by weld attachment. Alternatively, the blades 18 may be attached to the hub 14 only, or attached to both the disc 12 and the hub 14. Other attachment means, such as bolts or screws, may also be used for attaching the blades 18 to the disc 12 and/or to the hub 14.

For descriptive purposes, only one blade 18 will be described herein in detail. The disc impeller 10 preferably employs 4–12 blades 18. More preferably, as in the illustrated embodiment, the disc impeller 10 utilizes 8 blades. The disc impeller 10, however, may employ more or less blades depending on the application of the impeller. As depicted in FIG. 1, each individual blade 18 is preferably a unitary piece that includes the angled portion 22 along with a upper portion 24 which extends from the angled portion 22 to the disc 12. As illustrated in FIG. 1, the upper portion 24 is preferably oriented in a plane that is generally parallel to the axis of rotation 11 of the disc impeller 10. The angled portion 22 is preferably oriented in a plane that is at a 60° angle to the axis of rotation 11, which is also at a 60° angle to the plane of the upper portion 24.

The angled portion 22 is positioned such that it is located below the static liquid level line, generally designated A, and is connected to the upper portion 24. As illustrated in FIG. 1, the upper portion 24 of the blade 18 is connected to the angled portion 22 and extends upward above the static liquid level line A where it connects to the disc 12.

As illustrated in FIG. 1, each blade 18 includes an extension 20 that is preferably integral with the blade 18. As the name suggests, the extension 20 is an extension of the blade 18 that extends up, above the static liquid level line A, and out beyond the disc 12 of the disc impeller 10. The extension can vary in size, shape and design and is constructed and arranged to spray desirably well and therefore promote aeration of the liquid.

Also, as previously described, the blades 18 are oriented in the "back swept" position relative to the axis of rotation 11. By "back swept" position, it is understood that the center of the blades 18 is positioned behind a radial line that extends through the axis of rotation. More specifically, by "back swept" position, it is understood that the blades 18 are positioned at an angle ranging from approximately 10° to approximately 45° relative to a radial line that extends through the axis of rotation, and extends radially outward from the axis 11.

During operation, the disc impeller 10 depicted in FIG. 1 rotates in the counterclockwise direction, as indicated by the arrows, and the liquid is "up-pumped" by the disc impeller 10. By "up-pump" it is understood that the angled portion 22 of the blade 18 acts to scoop and/or lift the liquid upward so that it contacts the disc 12. During this process, gas or air mixes with the liquid as the liquid is being "up-pumped." As the liquid is "up-pumped" it contacts the disc. The disc 12 and blade configuration functions to create desired turbulence and gas/liquid contacting, while directing the liquid to flow radially outward away from the shaft 16. In addition, the extension 20 functions to produce a desired liquid spray pattern.

The aforementioned combination of the disc 12, blade 18 and extension 20 provide desired surface turbulence, a more uniform spray pattern and a desired liquid spray pattern, while providing satisfactory operating power values. This results in increased gas transfer to the liquid or aeration of the liquid while expending less power to operate the mixing assembly.

Figure 2:
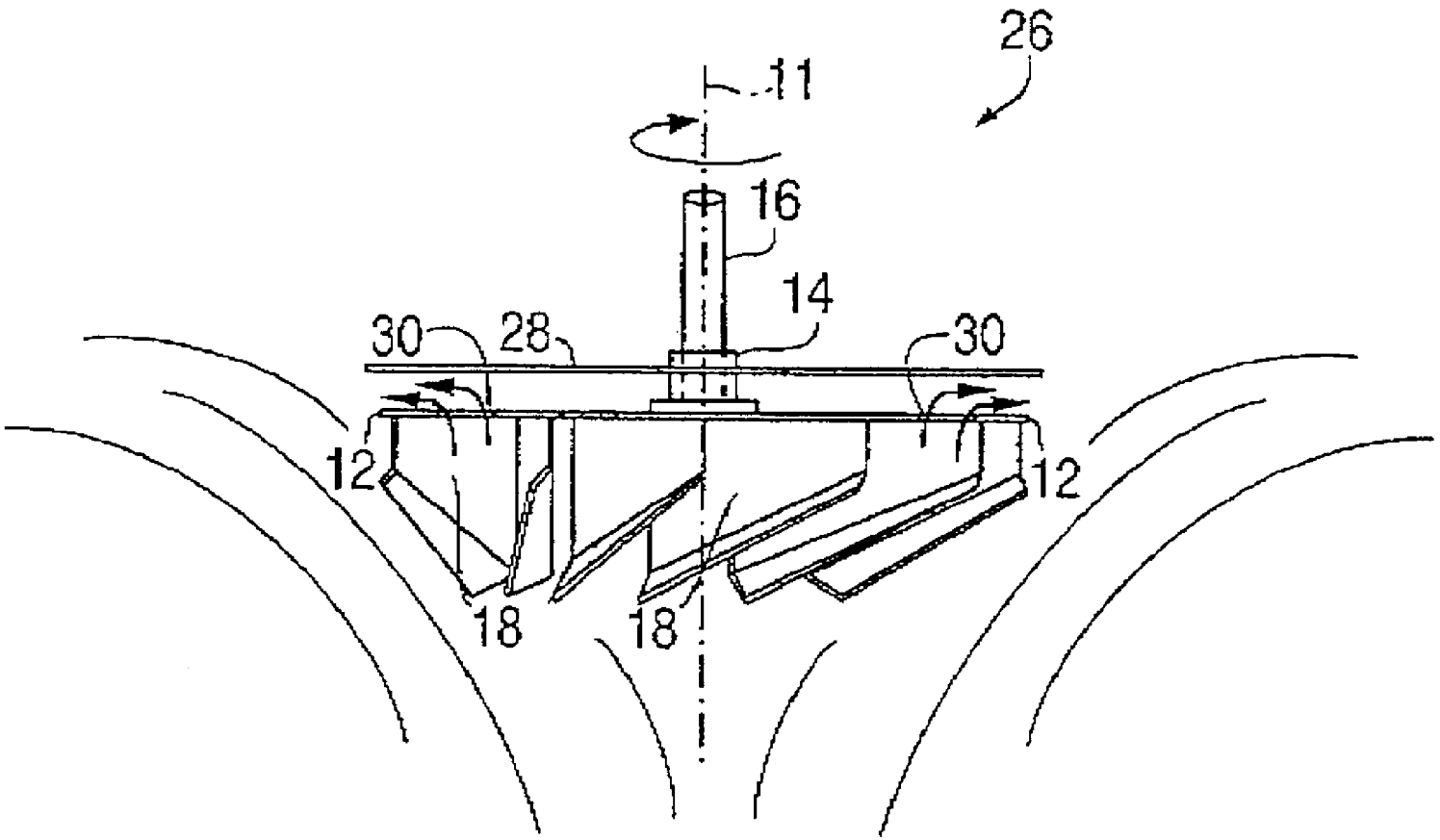
FIG. 2 is a partial perspective side view of a radial disc impeller having a second upper disc in accordance with another embodiment of the present invention.

Referring now to FIG. 2, an alternative embodiment of the disc impeller depicted in FIG. 1, generally designated 26, is illustrated in accordance with another embodiment of the present invention. The disc impeller 26 includes the disc 12, the hub 14 and the blades 18 as illustrated in the previous embodiment, however the disc impeller 26 additionally includes an upper disc 28 and slots or ports 30.

As the name suggests, the upper disc 28 is positioned at an axial location on the shaft 16 above the disc 12. The spacing between the discs 12, 28 can vary depending upon the radial disc impeller application, however the discs are preferably positioned apart with a space ranging from approximately 10% to approximately 15% of the disc 12 diameter. Alternatively, this distance may be less than 10% and/or greater than 15%, depending upon the disc impeller application. The upper disc 28 is preferably connected to the hub 14 and like disc 12, rotates with the shaft 16. Alternatively, the upper disc 28 may be attached directly to the shaft 16 or may connected to a second hub (not shown) if desired.

As depicted in FIG. 2, the disc impeller 26 also has slots or ports 30 located on the first disc 12 that perforate the disc 12 and extend through the disc 12. While only two slots 30 are illustrated, the disc impeller 26 preferably employs the same amount of slots 30 as blades. For example, the embodiment depicted in FIG. 2 employs eight blades 18 and therefore would preferably have eight slots or ports 30. The number of slots 30 may be more or less depending on disc impeller application.

During operation, the disc impeller is rotated in the counterclockwise direction as indicated by the arrow X, and the liquid is up-pumped via the blades 18. As previously described, the liquid contacts the disc 12 and the blade configuration, which functions to create desired turbulence and gas/liquid contacting, while directing the liquid to flow radially outward. However, in the embodiment illustrated in FIG. 2, a portion of the liquid is pumped through the slots 30, where it contacts the upper disc 28. As a result of this action, multiple spray patterns are produced as indicated by the arrows D, transferring gas to the liquid desirably well while the required operating power for the mixer assembly does not significantly increase.

Figure 3:
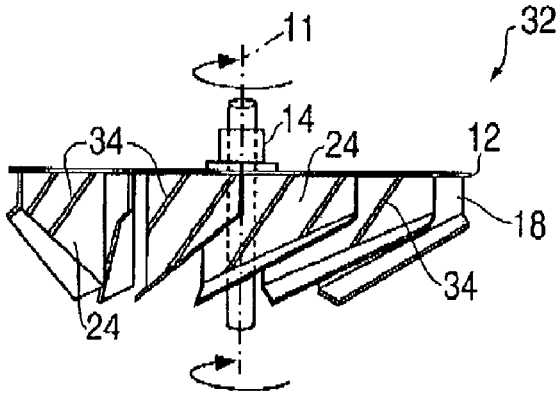
FIG. 3 is a partial perspective side view of a radial disc impeller having interrupters disposed the impeller blades in accordance with an embodiment of the invention.

Referring now to FIG. 3, another alternative embodiment of the radial disc impeller 10 depicted in FIG. 1 is illustrated in accordance with the present invention. The radial disc impeller, generally designated 32, includes the disc 12 and the hub 14 of the embodiment illustrated in FIG. 1, however it additionally includes interrupters 34 that extend along the upper portion 24 of the blade 18. The interrupters are preferably constructed and arranged to break apart liquid bubbles and/or gas bubbles that are formed on the blade 18 during mixer assembly operation, increasing aeration.

Preferably, two interrupters are disposed on each blade 18. However, more or less may be used depending upon the disc impeller application. Also, the interrupters 34 may positioned such that they extend outward, inward and/or vertical. By outward, it is understood that the they extend from the disc 12 at position in or close to the shaft 16, down toward the angled portion 22 and radially out, away from the shaft 16. By vertical, it is understood that the interrupters are generally parallel to the axis of rotation 11. By inward, it is understood that the interrupters 34 extend from the disc 12 at a position radially outward away from the shaft, down toward the angled portion 22, to a position radially inward toward the shaft 16. Further, the interrupters 34 can be segmented and a non-linear design.

Figure 4:
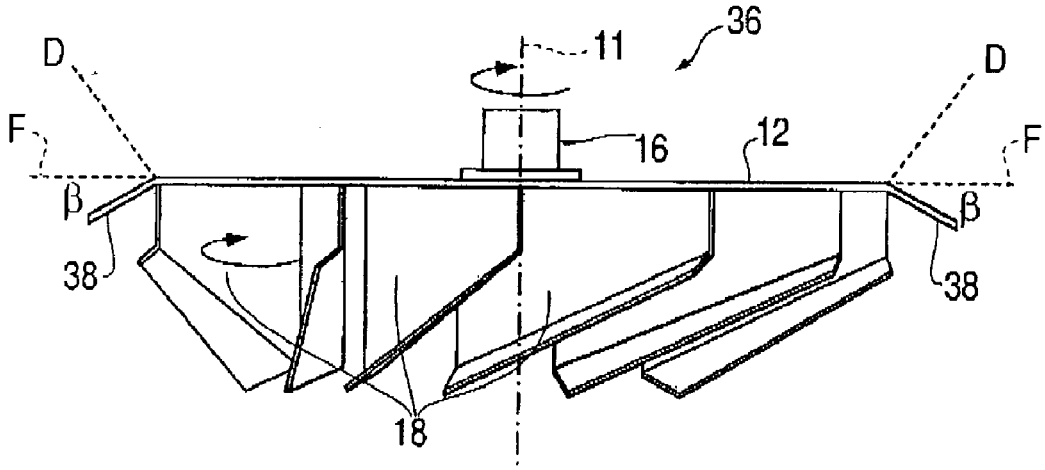
FIG. 4 is a partial perspective side view of a radial disc impeller having, a angled portion in accordance with an embodiment of the present invention.

Referring now to FIG. 4, yet another embodiment of the radial disc impeller 10 depicted in FIG. 1 is illustrated in accordance with the present invention. The radial disc impeller, generally designated 36, includes the disc 12, hub 14 and blades 18 as depicted in FIG. 1. As illustrated in FIG. 4, the disc 12 has a angled portion 38 extending radially away from the hub 16 and blades 18. The angled portion 38 extends generally downwardly at an angle β relative to a plane, generally designated F, in which the disc 12 lies. Preferably, the angle β ranges from approximately 0° to approximately 45° relative to the plane F. More preferably, angle β is equal to approximately 30°. Alternatively, angle β can range from approximately 0° to approximately minus 45° relative to the plane F, in which case the angled portions 38 extend, generally upward.

During operation, the disc impeller 36 depicted in FIG. 4 rotates in the counterclockwise direction, as indicated by the arrows, and the liquid is "up-pumped" by the disc impeller 10. As the liquid/gas mixture contacts the disc 12 and blade configuration, the disc 12 and blade configuration function to create desired turbulence and gas/liquid contacting, while directing the liquid to flow radially outward. Further, the angled portion 38 operates to direct and/or control the liquid flow and/or spray downward. This is beneficial, for example, in applications, where it is desired to reduce the spray diameter of the impeller. In these applications, the liquid spray contacts the mixing vessel walls at very high velocities, imparting energy on the vessel walls and not on the liquid surface, causing the aeration process to become inefficient. The angled portion 38 assists to direct the liquid spray downward, imparting its energy onto the liquid surface, increasing turbulence and therefore increasing aeration of the liquid.

Conversely, if a large spray diameter is desired, for example in applications where the impeller is small in size and the mixing vessel is large, β may be negative or angled upwardly, in the opposite direction, as indicated by line F. In this example, angle β is negative, and assists to increase the spray diameter.

Figure 5:
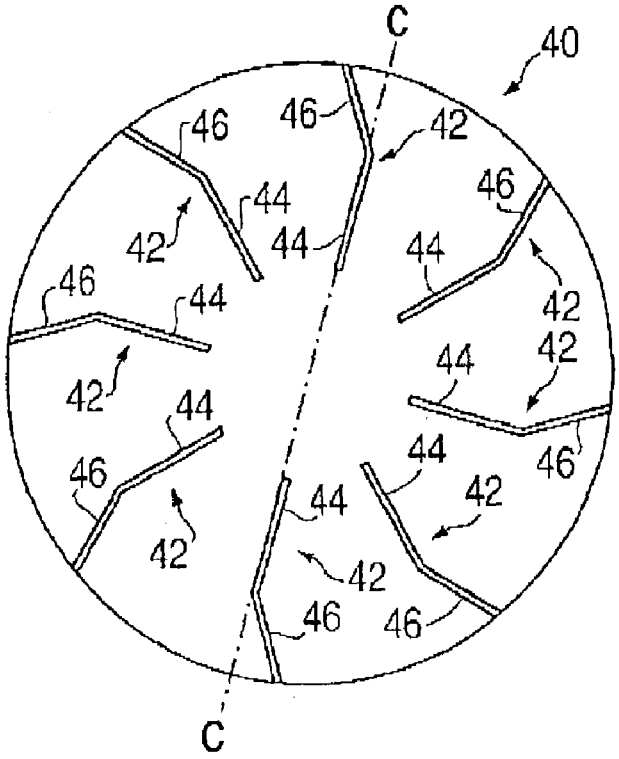
FIG. 5 is a bottom view of a radial disc impeller having angled blades in accordance with an embodiment of the present invention.
Figure 6:
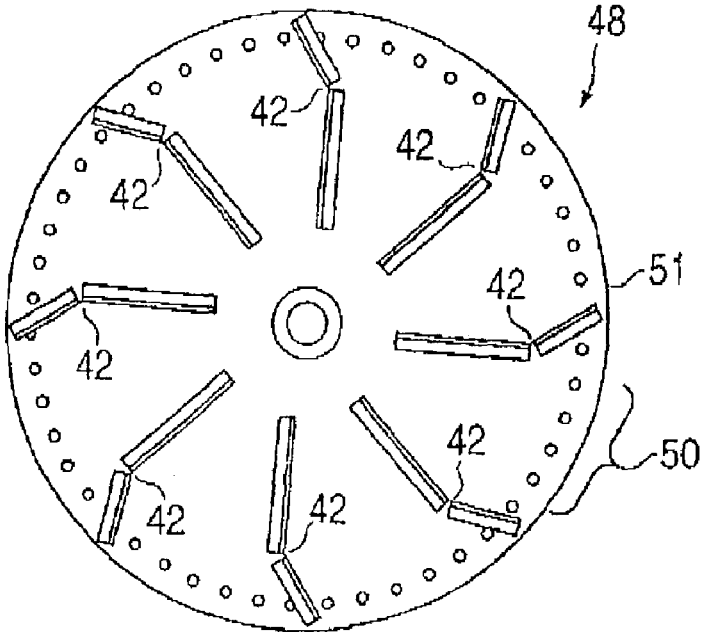
FIG. 6 is a bottom view of a radial disc impeller having segmented blades and disperser rods in accordance with an embodiment of the present invention.
Figure 7:
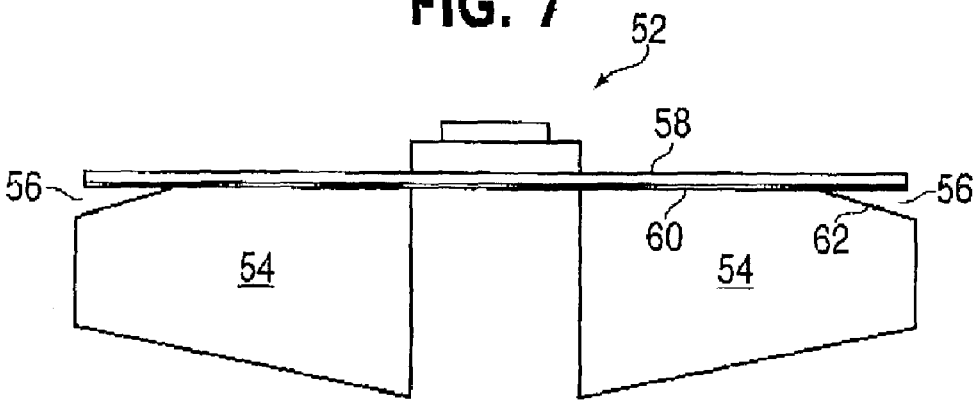
FIG. 7 is a partial side view of a radial disc impeller illustrating a blade design having a gap between the blade and the disc in accordance with an embodiment of the present invention.

Referring now to FIGS. 5–7, each figure depicts an alternative embodiment in accordance with the present invention for achieving efficient aeration of a liquid. These embodiments achieve desired, efficient aeration by providing desired fluid and air interaction, similar to the embodiments previously described in this application.

FIG. 5 depicts a radial disc impeller 40 having angled blades 42 wherein each blade has a first portion 44 and a second portion 46. FIG. 5 also illustrates a representative radial line C that extends through the axis of rotation of the impeller 40. The first portion 44 of each of the blades 42 is preferably oriented at an angle to its respective line C equal to approximately 0° to approximately 15°. FIG. 5 depicts the first portion 44 oriented at a 0° angle. The second portion 46 of the blades 42 is oriented at an angle to line C equal to approximately 30° to approximately 45°. Further, the blades 42 may alternatively displace or positioned angularly with respect to radial line C wherein various blades 42 may lie along line C while others do not.

FIG. 6 depicts an alternative embodiment of the radial disc impeller illustrated in FIG. 5. The disc impeller, generally designated 48, includes disperser rods 50. The disperser rods 50 extend axially downward away from the disc 51 and act to cause further interaction between the air and liquid bubbles. In the embodiment depicted, the blades 42 are segmented instead of unitary as illustrated in FIG. 5. The blades 42 may be segmented and/or unitary, depending upon application.

FIG. 7 depicts a partial side view of an alternative embodiment of a radial disc impeller 52 in accordance with the present invention, wherein the blades 54 are designed so that a gap 56 exists between the blade 54 and the disc 58. The blades 54 have top edge the includes two portions 60 and 62. Portion 60 is connected to the disc 58 while portion 32 does not connect to the disc 58. The aforementioned orientation of the portions 60, 62 forms the gap 56. The gap 56 is constructed and arranged to push fluid back into gas and/or air bubbles "clinging" to the blades, increasing liquid turbulence and therefore increasing liquid aeration between air and liquid.

Figure 8:
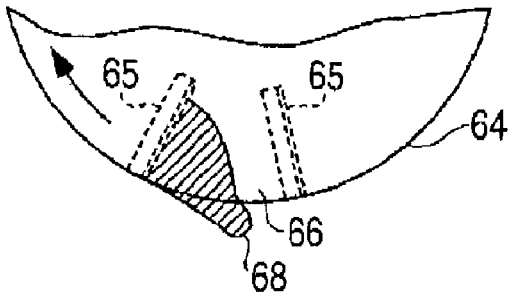
FIG. 8 is a partial bottom view illustrating the gas bubble and fluid interaction that occurs at the blades of the embodiments depicted in FIGS. 1–7.

FIG. 8 is an illustrative drawing of the bottom of a disc impeller 64, illustrating the liquid and gas interaction that takes place at the blade 65 level of the embodiments previously described herein and illustrated in FIGS. 1–7. The disc impeller 64 is rotating in the clockwise direction as indicated by the arrow and the gas bubbles 68 and fluid region 66 interact with one another, aerating the liquid. The previously described embodiments of the present invention function to increase the depicted interaction between the gas 68 and fluid/liquid, while providing satisfactory power values required to operate the impeller 64, thus, providing efficient aeration of the liquid.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A radial disc impeller for use with a liquid or liquid suspension mixing assembly having an axis of rotation, comprising:

a hub;

a first disc mounted to the hub having an outer periphery that extends a first distance radially away from the axis of rotation, said disc connected to the hub at a first axial location thereof; and at least a pair of blades connected to the disc, each of said blades having:

a first, upper portion lying in a plane parallel to the axis of rotation and at a back-swept angle relative to a radial plane passing through the axis of rotation; and an extension extending from said first, upper portion a second distance radially away from the axis of rotation that is greater than the first distance, so that said extension extends radially further away from the axis of rotation than the outer periphery of said first disc.

2. The radial disc impeller according to claim 1, wherein said blades each further comprise a second, lower portion angled relative to said first, upper portion, wherein each first, upper portion and respective second, lower portion lie in planes at different angles with respect to the axis of rotation.

3. The radial disc impeller according to claim 2, wherein said second, lower portion lies in a plane having an angle of approximately 60 degrees relative to the axis of rotation.

4. The radial disc impeller according to claim 1, wherein the back-swept angle of said first, upper portion is in a range from approximately 10 degrees to approximately 45 degrees relative to a radial plane extending through the axis of rotation.

5. A method for aerating a liquid in a liquid or liquid suspension mixing assembly having an axis of rotation, comprising;

mixing a liquid;

spraying the liquid in a radially direction in at least one spray pattern; and contacting the liquid with air, wherein the mixing step and the spraying step are carried out using a disc impeller comprising;

a hub;

a first disc mounted to the hub having an outer periphery that extends a first distance radially away from the axis of rotation, said disc connected to the hub at a first axial location thereof; and at least a pair of blades connected to the disc, each of said blades having:

a first, upper portion lying in a plane parallel to the axis of rotation and at a back-swept angle relative to a radial plane passing through the axis of rotation; and an extension extending from said first, upper portion a second distance radially away from the axis of rotation that is greater than the first distance, so that said extension extends radially further away from the axis of rotation than the outer periphery of said first disc.

6. The radial disc impeller according to claim 5, wherein said blades each further comprise a second, lower portion angled relative to said first, upper portion, wherein each first, upper portion and respective second, lower portion lie in planes at different angles with respect to the axis of rotation.

7. The radial disc impeller according to claim 6, wherein said second, lower portion lies in a plane having an angle of approximately 60 degrees relative to the axis of rotation.

8. The radial disc impeller according to claim 5, wherein the back-swept angle of said first, upper portion is in a range from approximately 10 degrees to approximately 45 degrees relative to a radial plane extending through the axis of rotation.

9. An apparatus for aerating a liquid for use in a mixing assembly having an axis of rotation, comprising;

means for contacting liquid with air, when the means for contacting comprises:

a hub;

a first disc mounted to the hub having an outer periphery that extends a first distance radially away from the axis of rotation, said disc connected to the hub at a first axial location thereof; and at least a pair of blades connected to the disc, each of said blades having;

a first upper portion lying in a plane parallel to the axis of rotation and at a back-swept angle relative to a radial plane passing through the axis of rotation; and an extension extending from said first, upper portion a second distance radially away from the axis of rotation that is greater than the first distance, so that said extension extends radially further away from the axis of rotation than the outer periphery of said first disc; and means for rotating said contacting means.

10. The radial disc impeller according to claim 9, wherein said blades each further comprise a second, lower portion angled relative to said first, upper portion, wherein each first, upper portion and respective second, lower portion lie in planes at different angles with respect to the axis of rotation.

11. The radial disc impeller according to claim 10, wherein said second, lower portion lies in a plane having an angle of approximately 60 degrees relative to the axis of rotation.

12. The radial disc impeller according to claim 9, wherein the back-swept angle of said first, upper portion is in a range from approximately 10 degrees to approximately 45 degrees relative to a radial plane extending through the axis of rotation.

* * * * *